US007963442B2

(12) United States Patent
Jenkins et al.

(10) Patent No.: US 7,963,442 B2
(45) Date of Patent: Jun. 21, 2011

(54) SPIN STABILIZED PROJECTILE TRAJECTORY CONTROL

(75) Inventors: Dennis Hyatt Jenkins, Newport, VT (US); Jim Byrne, Williston, VT (US); John Christiana, Huntington, VT (US); Paul Franz, Shelburne, VT (US); Tom Kelly, Vergennes, VT (US)

(73) Assignee: Simmonds Precision Products, Inc., Vergennes, VT (US)

( * ) Notice: Subject to any disclaimer, the term of this patent is extended or adjusted under 35 U.S.C. 154(b) by 738 days.

(21) Appl. No.: 11/639,364

(22) Filed: Dec. 14, 2006

(65) Prior Publication Data

US 2008/0142591 A1 Jun. 19, 2008

(51) Int. Cl.
*G06F 19/00* (2011.01)

(52) U.S. Cl. ..... 235/411; 235/400; 235/403; 235/404; 235/405; 235/412; 244/3.1; 244/3.2; 244/3.21; 244/3.23; 244/3.29

(58) Field of Classification Search ..... 235/411, 235/403, 404, 407, 412, 413; 244/3.1, 3.15, 244/3.2, 3.23, 3.28
See application file for complete search history.

(56) References Cited

U.S. PATENT DOCUMENTS

| | | | | |
|---|---|---|---|---|
| 4,176,814 | A | 12/1979 | Albrektsson et al. | |
| 4,399,962 | A | 8/1983 | Wedertz et al. | |
| 4,426,048 | A | 1/1984 | Mildren | |
| 4,431,147 | A | 2/1984 | Paley | |
| 4,431,150 | A * | 2/1984 | Epperson, Jr. | 244/3.21 |
| 4,438,893 | A | 3/1984 | Sands et al. | |
| 4,565,340 | A | 1/1986 | Bains | |
| 4,579,298 | A | 4/1986 | Thomson | |
| 4,600,166 | A | 7/1986 | Califano et al. | |

(Continued)

FOREIGN PATENT DOCUMENTS

DE 36 06 423 A1 9/1987

(Continued)

OTHER PUBLICATIONS

"Angular Momentum", http://en.wikipedia.org/wiki/Angular_momentum, acquired Oct. 21, 2010.*

*Primary Examiner* — Thien M. Le
*Assistant Examiner* — Christopher Stanford
(74) *Attorney, Agent, or Firm* — Muirhead and Saturnelli, LLC

(57) ABSTRACT

A Reconfigurable Nose Control System (RNCS) is designed to adjust the flight path of spin-stabilized artillery projectiles. The RNCS uses the surface of a projectile nose cone as a trim tab. The nose cone may be despun by the action of aerodynamic surfaces, to zero spin relative to earth fixed coordinates using local air flow, and deflected by a simple rotary motion of a Divert Motor about the longitudinal axis of the projectile. A forward section of the nose cone having an ogive is mounted at an angle to the longitudinal axis of the projectile, forming an axial offset of an axis of the forward section with respect to the longitudinal axis of the projectile. Another section of the nose cone includes another motor, the Roll Generator Motor, that is rotationally decoupled from the forward section and rotates the deflected forward section so that its axis may be pointed in any direction within its range of motion. Accordingly, deflection and direction of the forward section may be modulated by combined action of the motors during flight of the projectile.

20 Claims, 8 Drawing Sheets

U.S. PATENT DOCUMENTS

| | | | |
|---|---|---|---|
| 4,665,332 | A | 5/1987 | Meir |
| 4,676,456 | A | 6/1987 | Grosso et al. |
| 4,754,707 | A | 7/1988 | Ahlers |
| 4,793,571 | A | 12/1988 | Kranz |
| 4,840,328 | A | 6/1989 | Sundermeyer |
| 4,883,239 | A | 11/1989 | Lachmann et al. |
| 4,925,130 | A | 5/1990 | Kranz |
| 4,927,096 | A | 5/1990 | Kranz |
| 4,964,593 | A | 10/1990 | Kranz |
| 4,982,913 | A | 1/1991 | Miller |
| 4,998,994 | A | 3/1991 | Schmidt et al. |
| 5,083,724 | A | 1/1992 | Kranz |
| 5,085,380 | A | 2/1992 | Barton |
| 5,139,215 | A | 8/1992 | Peckham |
| 5,139,216 | A | 8/1992 | Larkin |
| 5,398,887 | A | 3/1995 | Wassom et al. |
| 5,452,864 | A | 9/1995 | Alford et al. |
| 5,647,558 | A | 7/1997 | Linick |
| 5,762,291 | A | 6/1998 | Hollis et al. |
| 5,775,636 | A | 7/1998 | Vig et al. |
| 5,788,178 | A | 8/1998 | Barrett, Jr. |
| 5,816,531 | A | 10/1998 | Hollis et al. |
| 5,826,821 | A | 10/1998 | Brandon et al. |
| 6,126,109 | A | 10/2000 | Barson et al. |
| 6,135,387 | A | 10/2000 | Seidel |
| 6,163,021 | A | 12/2000 | Mickelson |
| 6,283,407 | B1 | 9/2001 | Hakenesch |
| 6,317,688 | B1 | 11/2001 | Bruckner et al. |
| 6,318,667 | B1 | 11/2001 | Morton |
| 6,325,325 | B1 | 12/2001 | Bonnet et al. |
| 6,345,785 | B1 | 2/2002 | Harkins et al. |
| 6,349,652 | B1 | 2/2002 | Hepner et al. |
| 6,364,248 | B1 | 4/2002 | Spate et al. |
| 6,402,087 | B1 | 6/2002 | Farina et al. |
| 6,467,721 | B1 | 10/2002 | Kautzsch et al. |
| 6,511,016 | B2 | 1/2003 | Bär et al. |
| 6,573,486 | B1 | 6/2003 | Ratkovic et al. |
| 6,588,700 | B2 | 7/2003 | Moore et al. |
| 6,616,093 | B1 | 9/2003 | Albrektsson et al. |
| 6,646,242 | B2 | 11/2003 | Berry et al. |
| 6,666,123 | B1 | 12/2003 | Adams et al. |
| 6,666,402 | B2 | 12/2003 | Rupert et al. |
| 6,682,014 | B1 | 1/2004 | Hickey |
| 6,764,042 | B2 | 7/2004 | Moore et al. |
| 6,820,025 | B2 | 11/2004 | Bachmann et al. |
| 6,845,714 | B1 | 1/2005 | Smith et al. |
| 6,882,747 | B2 | 4/2005 | Thawonmas et al. |
| 6,959,893 | B1 | 11/2005 | Sadowski et al. |
| 6,966,526 | B2 | 11/2005 | Lawless |
| 6,981,672 | B2 | 1/2006 | Clancy et al. |
| 7,002,126 | B2 | 2/2006 | Gnemmi et al. |
| 7,249,730 | B1 * | 7/2007 | Flippen, Jr. ..... 244/3.15 |
| 2006/0065775 | A1 * | 3/2006 | Smith et al. ..... 244/3.23 |

FOREIGN PATENT DOCUMENTS

| | | | |
|---|---|---|---|
| EP | 0 675 335 | A2 | 10/1995 |
| EP | 1 103 779 | A1 | 5/2001 |
| EP | 1 635 135 | A1 | 3/2006 |

* cited by examiner

SPIN STABILIZED PROJECTILE TRAJECTORY CONTROL

TECHNICAL FIELD

This application is directed to the field of ballistics and, more particularly, to projectile trajectory control.

BACKGROUND OF THE INVENTION

Spin stabilized artillery projectiles are gyroscopically stabilized, spinning rapidly about the projectile's longitudinal axis resulting from the action of the rifling during the launch sequence. In free flight after muzzle exit, aerodynamic forces act on the projectile body, producing a complex epicyclic motion of nutation and precession throughout the trajectory that may affect, and otherwise interfere with, a desired trajectory of the projectile.

As the range capability of artillery weapons and ammunition grows, accuracy and precision of delivery become increasingly important. Total delivery errors for standard, unguided 155 mm artillery projectiles, including all error sources, can exceed 300 meters at 30 km, while a point target size may be less than ten square meters. In such a case, the probability of hitting a specific point target at extended range will be low unless a large number of rounds are fired. A number of schemes have been proposed to provide some measure of control over the flight path of spin-stabilized projectiles, all aimed at enhancing the accuracy and precision of artillery fire sufficiently to improve the chance of impact at point targets at extended ranges with reduced expenditure of ammunition and without inflicting collateral damage on objects located in the vicinity of the desired target.

Previously proposed methods of trajectory correction fall into one of several generic types. There are known device, commonly called "dragsters," that act to abruptly increase the drag of the projectile at some point in the flight of the projectile, causing the projectile to fall towards the target. There are also devices that have wings, known as "canards," that are attached to a forward portion of the projectile. Some designs have fixed wings or canards, while others initially package the canards within the projectile, deploying only when trajectory adjustment is desired. There are also thruster schemes proposed that employ explosive charges or small thruster rocket motors to apply lateral force to the projectile during flight.

The previously proposed methods of trajectory correction are generally operationally limited or require complex implementation that may not be cost effective, such that none of the above-described methods have been adapted into widespread use. For example, dragster devices must be fired to over-shoot the target, and can only correct for down-range errors, not cross-range errors. Thus, dragster devices are often termed one dimensional correctors. Meteorological data that is not up-to-date ("stale MET"), or that is gathered at a location some distance from the projectile, may result in substantial cross-range errors that may not be corrected by one-dimensional dragster devices.

Canard devices may substantially increase drag of the projectile when deployed, thereby decreasing efficiency. Canards and their actuating mechanisms may also occupy large volumes of restricted space within the projectile, and require substantial power resources to operate. The relatively high drag of canard devices when deployed to control the projectile flight path may restrict the use of canard devices, in practice, to the terminal phase of the trajectory to avoid unacceptable range penalties. However, deployment late in the trajectory may reduce the total correction capability ("maneuver authority") of the canard devices. Moreover, it may not be practical to arrange the canards to be retractable as well as deployable because of power, weight and complexity constraints.

Thruster devices may need to be small to fit within the restricted available space of the projectile, and the trajectory correction capability of the thruster devices may be strictly limited. For thrusters positioned other than near the center of mass, thruster operation may induce excessive oscillations that affect accuracy in projectile angle of attack.

Accordingly, it would be beneficial to provide a system for spin stabilized projectile trajectory control that is simple, effective and cost efficient to implement and operate.

SUMMARY OF THE INVENTION

A Reconfigurable Nose Control System (RNCS) according to the system described herein is designed to adjust the flight path of spin-stabilized artillery projectiles. The RNCS may use the surface of a nose cone of a projectile as a trim tab. The nose cone may be despun by the action of specifically designed aerodynamic surfaces to zero spin relative to earth fixed coordinates using local air flow, and deflected by a simple rotary motion of a motor, or other actuator, about the longitudinal axis of the projectile, as further described elsewhere herein. A forward section of the nose cone having an ogive is mounted at an angle to the longitudinal axis of the projectile, forming an axial offset of an axis of the forward section with respect to the longitudinal axis of the projectile. At one extreme of the motor's rotary motion, the axis of the forward section and the longitudinal axis of the projectile are coincident, resulting in zero deflection, and which may be the launch configuration. At the other extreme of the motor's rotary motion, the maximum forward section deflection may be two times the axial offset. Another motor rotates the deflected forward section so that its axis may be pointed in any direction within its range of motion.

According to the system described herein, an apparatus for controlling a trajectory of a projectile includes first and second sections disposed on the projectile. The first section has a longitudinal axis that is at an axial offset about a longitudinal axis of a projectile body and that rotates about the longitudinal axis of the projectile body. The second section rotates about the longitudinal axis of the projectile body and is rotationally decoupled from the first section. An on-board processor controls rotation of the first section and rotation of the second section. The on-board processor receives trajectory information during flight of the projectile, and controls the rotations of the first and the second sections to adjust a predicted impact point of the projectile with respect to target coordinates. The rotations of the first and second sections determine a deflection and orientation. The on-board processor may determine the predicted impact point of the projectile. The apparatus may further include a data-receiver coupled to the on-board processor and which may be a GPS. The first section may include an ogive portion and aerodynamic surfaces disposed on an external surface of the first section. A first motor may control an orientation of the first section and a second motor may control a deflection of the first section with respect to the longitudinal axis of the projectile body. The apparatus may further include a generator that generates power from a spin differential between at least one of the first and second sections and the projectile body or a base section rotationally coupled to the projectile body. The on-board processor may iteratively determine trajectory solutions during the flight of the projectile and iteratively adjust the rotations of the first and second sections.

According further to the present system, computer software, stored in a computer readable medium, controls a trajectory of a projectile. Executable code receives trajectory information data of the projectile. Executable code receives a predicted mean point of impact for the projectile based on the trajectory information data. Executable code compares the predicted mean point of impact with target coordinates input to the projectile prior to launch. Executable code adjusts a trajectory of the projectile by rotating a first section of the projectile with respect to a longitudinal axis of a body of the projectile and rotating a second section of the projectile with respect to the longitudinal axis, wherein rotation of the first section is decoupled from rotation of the second section. Executable code may determine the predicted mean point of impact for the projectile based on the trajectory information data. A deflection and orientation of the first section is controlled by the rotations of the first section and the second section. The mean point of impact may be predicted using a modified point mass trajectory solution.

According further to the present system, a method of controlling a trajectory of a projectile includes receiving trajectory information of the projectile. A mean point of impact is received for the projectile based on the trajectory information data. The predicted mean point of impact is compared with target coordinates input to the projectile prior to launch. A trajectory of the projectile is adjusted by rotating a first section of the projectile with respect to a longitudinal axis of the projectile and rotating a second section of the projectile with respect to the longitudinal axis, wherein rotation of the first section is decoupled from rotation of the second section. A deflection and orientation of the first section is controlled by the rotations of the first section and the second section. The mean point of impact may be predicted using a modified point mass trajectory solution. The method may further include generating power based on a spin differential between the body of the projectile and at least one of the first and second sections. The above-noted steps may be performed iteratively during flight of the projectile.

BRIEF DESCRIPTION OF THE DRAWINGS

Embodiments of the system are described with reference to the several figures of the drawings, in which.

DETAILED DESCRIPTION OF VARIOUS EMBODIMENTS

Referring now to the figures of the drawings, the figures comprise a part of this specification and illustrate exemplary embodiments of the described system. It is to be understood that in some instances various aspects of the system may be shown schematically or may be exaggerated or altered to facilitate an understanding of the system.

Figure 1:
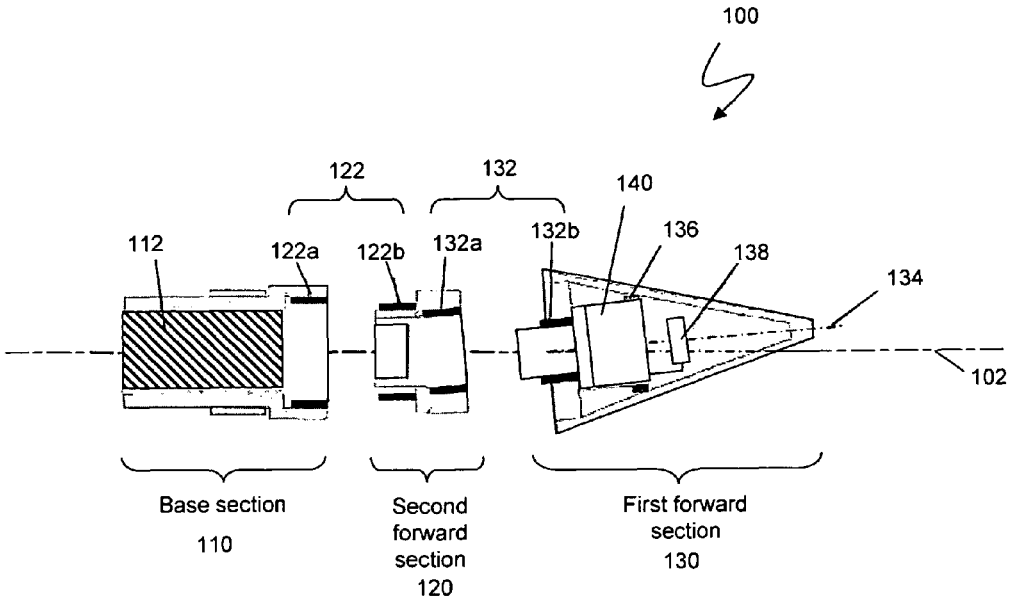
FIG. 1 illustrates an embodiment of a Reconfigurable Nose Control System according to an embodiment of the system described herein.

FIG. 1 illustrates an embodiment of a Reconfigurable Nose Control System (RNCS) 100 according to the system described herein. The RNCS 100 may include three sections: a first forward section 130, a second forward section 120 and a base section 110. The base section 110 may interface with a projectile body and include a fuze volume 112 to interface with fuze threads of the projectile body. The base section 110 and the second forward section 120 may include a Roll Motor Generator (RMG) 122, that functions as discussed elsewhere herein and may include other components as part of a roll motor generator assembly. The first forward section 130 and the second forward section 120 may include a Divert Motor (DM) 132, that functions as discussed elsewhere herein and may include other components as part of a divert motor assembly. The DM 132 may be used to deflect the first forward section of the nose cone, as further discussed elsewhere herein. As illustrated, the first forward section 130 may include an ogive portion, which is a curved surface used to form the aerodynamically streamlined nose of the projectile.

The first forward section 130 may be disposed at an axial offset 134 with respect to a longitudinal axis 102 of the projectile body. The axial offset 134 may be five degrees, although other deflection values may be selected in accordance with the operating principle of the system described herein. The deflection of the first forward section 130 may then be controlled to a value, for example between zero and two times the axial offset (ten degrees), by simple rotary motion of a motor, such as the Divert Motor (DM) 132, or other actuator. Using a motor, such as the Roll Motor Generator (RMG) 122, or other actuator, the deflected ogive of the first forward section 130 may be rotated so that its axis points in any direction or orientation within its range of motion. Accordingly, the second forward section 120 deflection and orientation may be modulated by action of the DM 132 and the RMG 122, as further discussed elsewhere herein.

In an embodiment, the DM 132 includes a magnet component 132*a* and a wiring component 132*b* and the RMG 122 includes a magnet component 122*a* and a winding component 122*b*, that may be implemented as stator/rotor configurations as part of electromagnetic motors. Other motor configurations and operations are possible and may be suitable for implementation with the present system. For example, piezoelectric motors may be used.

The projectile may include one or more mechanisms for transmitting and receiving data during launch and flight. In an embodiment, the RCNS 100 includes an inductive fuze setter coil 136 that may be used to receive data transmitted to the projectile, such as time-of-flight data, time-to-burst data, target coordinates, and/or other data. The inductive fuze setter coil 136 may be inductively coupled to an external device (not shown) which may also include a coil which, when placed in close proximity to the internal coil within the projectile, becomes inductively coupled to the internal projectile coil. The external device coil may be excited and modulated to communicate data to the projectile, and the internal inductive fuze setter coil 136 receives the data that may then be provided to appropriate on-board electronic circuitry 140 included within the projectile. In other embodiments, other data transfer mechanisms may be used for transferring data to and from the projectile during launch and flight, including the use of a Global Positioning System (GPS) 138, as further discussed elsewhere herein.

Figure 2:
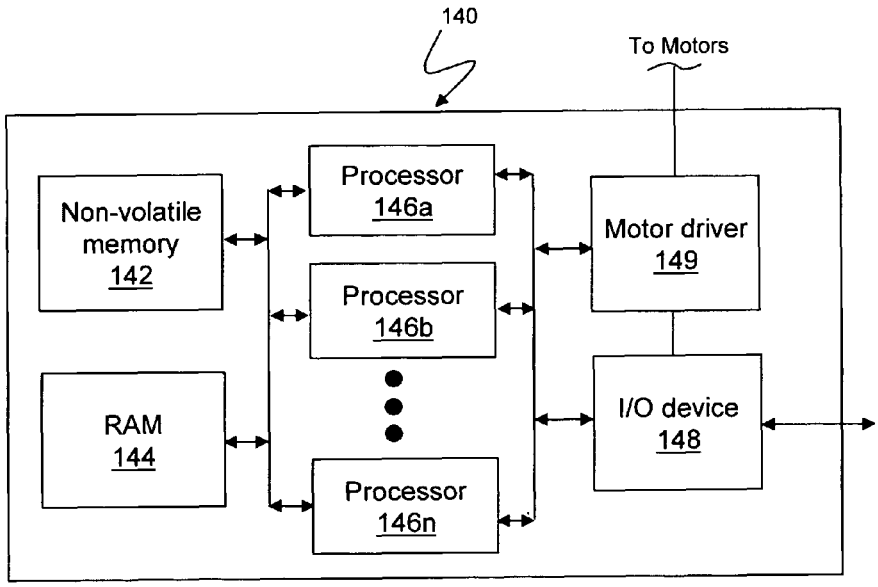
FIG. 2 is a schematic illustration of the on-board circuitry of a Reconfigurable Nose Control System according to an embodiment of the system described herein.

FIG. 2 is a schematic illustration of the on-board electronic circuitry 140 of the RNCS 100 according to an embodiment of the system described herein. The on-board electronic circuitry 140 of the projectile may include non-volatile memory 142, RAM or other volatile memory 144, one or more on-board processors 146*a*, 146*b* . . . 146*n*, and/or an input/output device 148. The input/output device 148 may operate in connection with the inductive fuze setter device 136, the GPS 138, and/or other data transfer mechanisms external to the RNCS 100. The on-board electronic circuitry 140 may be electrically coupled to the DM 132 and the RMG 122 via a motor driver 149 that controls modulation of the DM 132 and RMG 122 to adjust the deflection and direction of the first forward section 130 according to in-flight calculations performed by the on-board electronic circuitry 140 in response to data received by the RNCS 100, as further discussed elsewhere herein. In some embodiments, the motors 122, 132 may include sensors that provide feedback to the on-board electronic circuitry 140 to confirm appropriate actuation of the motors 122, 132 in accordance with actuation signals generated by the motor driver 149.

The deflection and direction of the first forward section 130 of the nose cone drives the projectile body to assume an angle of attack relative to local air flow, where the moment of aerodynamic forces from the projectile body angle of attack counterbalances the moment of aerodynamic forces from the deflected nose cone. The resultant of the aerodynamic forces acting on the entire projectile, including nose cone, acts to modify the flight path followed by the projectile, and the location of the impact point is appropriately adjusted. The deflection and direction of the first forward section 130 may be completely reversible at any time during flight through function of the rotations of the RMG 122 and DM 132, thereby returning the projectile during flight to a purely ballistic configuration of minimum drag, if desired.

The following provides a more detailed description of a nose cone articulation scheme according to the system described herein and refers to FIGS. 3-6. To understand the geometric laws governing motion of a control surface of the nose cone, consider two cylindrical discs, both with one surface cut at the same angle. When the two discs are aligned and in contact with each other, there is one orientation where the two ends of the composite cylinder are parallel to each other. The two discs may be defined as "A" and "B", and the relative orientation to produce parallel ends of discs A and B as $\phi_A=0°$, and $\phi_B=180°$.

Figure 3:
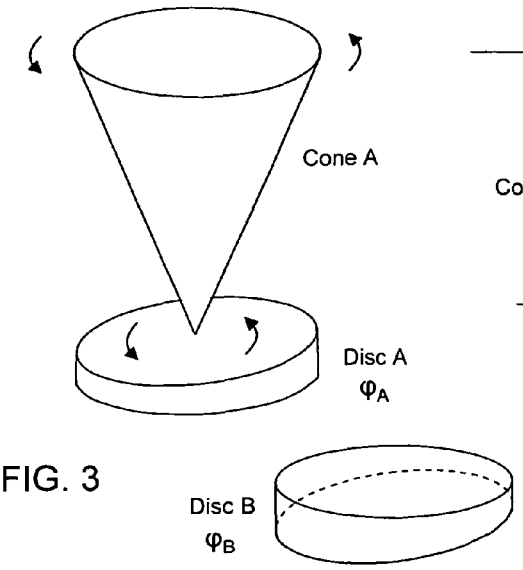
FIGS. 3-6 are schematic illustrations of a nose articulation scheme according to an embodiment of the system described herein.

If disc A is rotated between 0° and 360°, an axis normal to the inclined surface will trace the surface of a cone, with the apex at the center of rotation of disc A, as shown in FIG. 3.

Figure 4:
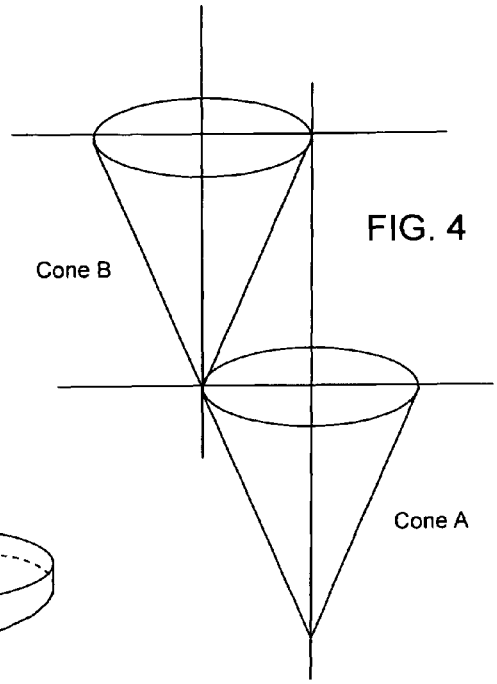

If disc B is then superposed on the inclined surface of disc A and disc B also rotated between 0° and 360°, then each point on the base circumference of cone A represents the origin of a similar conical surface, cone B, as shown in FIG. 4.

If cone A and cone B are 180° out of phase, the lateral displacement of the vertical axis struck from the vertical axis of disc B relative to the vertical axis of disc A is zero. At all other orientations of disc B, $\phi_B$, there is a deflection of the vertical axis by a predictable amount and in a predictable direction.

By proper selection of $\phi_A$ and $\phi_B$, it is possible to obtain a specific magnitude of deflection, and a specific orientation of that deflection. The deflection and orientation may be quantified in terms of $\phi_A$ and $\phi_B$.

Figure 5:
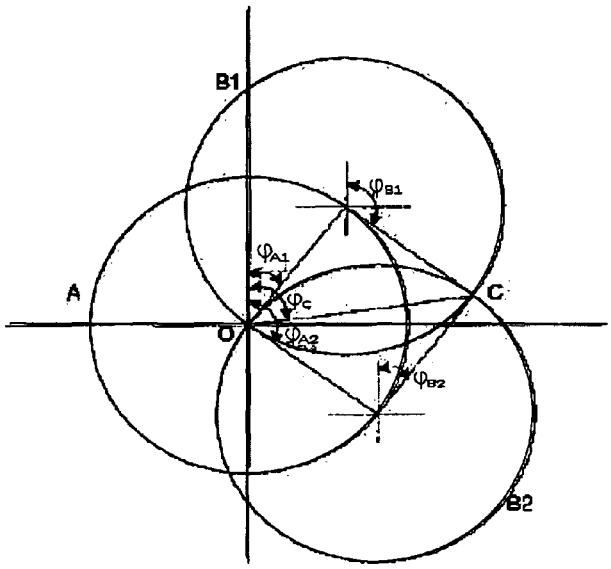

Consider the general case shown in FIG. 5, which illustrates the providing of a deflection of magnitude OC oriented at phase angle $\phi_C$. There are two solutions:

(1) Rotate disc A to $\phi_{A1}$, and disc B to $\phi_{B1}$; or (2) Rotate disc A to $\phi_{A2}$, and disc B to $\phi_{B2}$.

Note that in all cases, $\phi_{A1}=\phi_{B2}$, and $\phi_{A2}=\phi_{B1}$.

OC bisects the diagonal of a rhombus (for the case where discs A and B are equal in size).

Thus, $$\phi_C = [(\varphi_{A2} - \varphi_{A1})/2] + \varphi_{A1} = [(\varphi_{B1} + \varphi_{A1})/2] = [(\varphi_{A2} + \varphi_{B2})/2] \quad \text{Equation (1)}$$

OC is the base of two isosceles triangles, one for each solution. Thus, $$OC=2r\cdot\cos[(\phi_{B1}-\phi_{A1})/2]=2r\cdot\cos[(\phi_{A2}-\phi_{B2})/2] \quad \text{Equation (2)}$$

where r is radius of both discs A and B.

Figure 6:
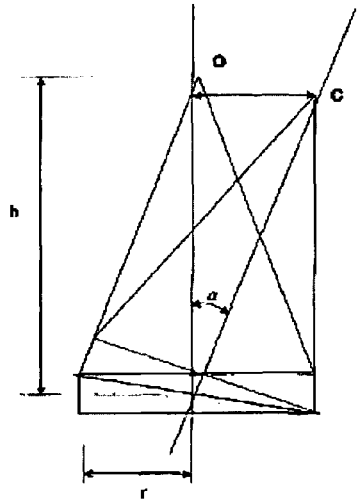

As shown in FIG. 6, for a nose cone affixed to disc B upper surface, giving total height "h" and having base radius "r", the deflection angle "α" is related to OC as follows:

$$OC=h\sin\alpha \quad \text{Equation (3)}$$

Therefore, applying Equations (2) and (3) yields:

$$\sin\alpha=(2r/h)\cdot\cos[(\phi_{A2}-\phi_{B2})/2]=(2r/h)\cdot\cos[(\phi_{B1}-\phi_{A1})/2] \quad \text{Equation (4)}$$

Since "r" and "h" are constants, and "$\phi_C$" and "α" are determined from trajectory considerations, determination of the unknowns $\phi_{A1}$, $\phi_{A2}$ and $\phi_{B1}$, $\phi_{B2}$ can be made using Equations (1) and (4).

As described herein, the RNCS 100 produces a small side force on the ogive portion of the first forward section 130 by deflecting the nose cone so that the longitudinal axis of the nose cone forms an angle with the longitudinal axis of the projectile and hence the local air flow. Since the nose cone is despun to zero relative to earth-fixed coordinates soon after muzzle exit, the asymmetry of nose forces causes the projectile to assume a body angle of attack relative to local air flow. This body angle of attack generates forces acting through the projectile center of mass to modify the ground impact point by a predictable amount. For a specific projectile, the magnitude and direction of the impact point modification may depend on the commanded nose angle of attack, pointing angle of the nose cone axis relative to earth fixed coordinates, projectile velocity, local air density, duration of application of control force, and/or other criteria.

The mechanisms of the RNCS 100 producing the nose control deflection may involve a simple rotary motion of two motors or actuators, as discussed elsewhere herein, and hence exhibit high reliability and ruggedness, with low manufacturing and assembly cost. In one embodiment, the rearmost section base section 110 incorporates threads interfacing with the standard fuze threads of the projectile, and spins at the full spin of the projectile. The two forward sections 120, 130 of the RNCS 100 may be locked together before active control begins and to the rearmost base section during launch and subsequently unlocked after launch. In other embodiments, other actuator types and configurations may be suitable for use with the present system including, for example, the use of a tilt actuator and a rotary actuator (see, for example, U.S. Pat. No. 6,364,248 to Spate et al., which is incorporated herein by reference).

Figure 7A:
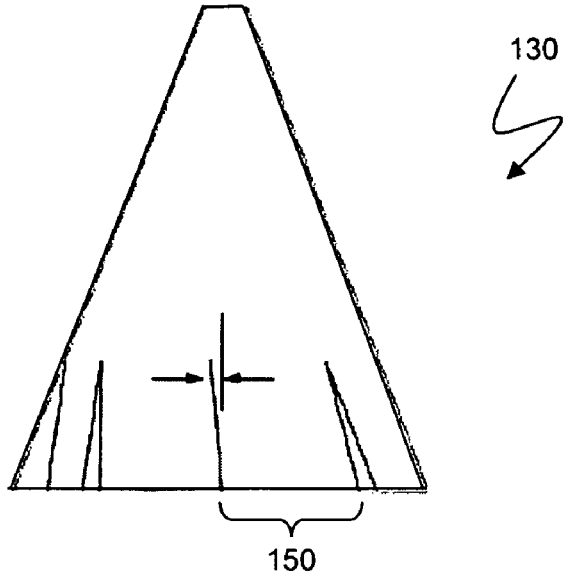
FIGS. 7A and 7B are schematic views of a nose cone showing an example of aerodynamic surfaces to despin the first and second sections on an external surface according to an embodiment of the system described herein.
Figure 7B:
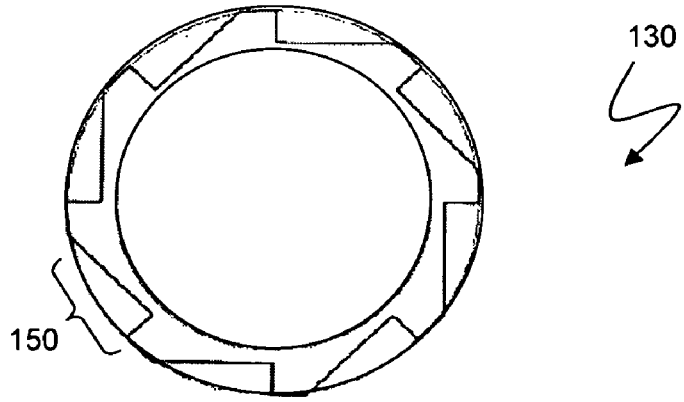

As seen in FIGS. 7A and 7B, an external surface of the nose cone first forward section 130 may include a number of aerodynamic surfaces 150 designed to induce a roll torque about the longitudinal axis of the nose cone. In these figures the aerodynamic surfaces are exemplified as undercuts (e.g., strakes), but could also be any other of a number of appropriate surfaces capable of performing a similar function. FIG. 7A is a side view of the external surface of the first forward section 130, and FIG. 7B is a view from the base section looking forward to the first forward section 130. The aerodynamic surfaces 150 may be designed to produce a roll torque in response to local air flow that opposes the spin of the projectile (for example, clockwise as viewed from the base of the projectile looking forward in FIG. 7A). The roll torque generated by the aerodynamic surfaces 150 rapidly despins the two forward nose cone sections 120, 130 following muzzle exit, reaching zero spin relative to earth fixed coordinates in less than two seconds. Free rotation under action of local air flow may cause the forward nose cone sections 120, 130 to rotate at a small percentage of the projectile spin, and in the opposite sense depending on specific design features of the aerodynamic surfaces 150.

Referring again to FIG. 1, as further discussed in detail elsewhere herein, a first motor (e.g., RMG 122) may be positioned in the second forward section 120 of the RNCS 100 and used for rotary positional control while a second motor (e.g. DM 132) may be mounted on the second forward section 120 of the RNCS 100 and provide a means of rotating the first forward section relative to the second forward section, as further discussed elsewhere herein. By appropriate manipulation of the rotary motions of the RMG and DM, the nose deflection can be driven in a planar manner directly to the desired deflection magnitude and orientation. For example, this planar motion may be achieved by rotating the RMG 122 in one direction and the DM 132 in the opposite direction.

Furthermore, the large differential spin between the rearmost base section 110 of the RNCS 100 (that is coupled to the rotation of the projectile body) and the two forward sections 120, 130 (that are decoupled from rotation of the projectile body) may be used to generate electrical power that may serve all electrical circuits and components in the RNCS 100. In one embodiment, the RMG 122 may be used to generate the electrical power for the RNCS 100. Further, an active transistor component may be used as a variable load for the RMG 122 and provide precise control of the generated power. Thus, the RNCS 100 may not need to contain any additional energy storage devices such as batteries or capacitors, and therefore may be stored indefinitely without maintenance. (For an example of electric generator assemblies for a projectile, see U.S. Pat. No. 6,845,714 to Smith et al., and U.S. Pat. No. 4,665,332 to Meir, which are incorporated herein by reference.) Alternatively, additional energy storage devices may be included and used in connection with the system described herein.

The RMG 122 may begin generating power shortly after launch (for example, at about two hundred msec). At about two seconds after launch, the variable load starts controlling rotation of the first forward section 130 and second forward section 120 to a small fraction of full spin (for example, approximately eighteen Hz in an opposite sense to the spin of the projectile body) while acquiring GPS signals through the GPS 138 that may be mounted in the front of the first forward section 130. The exact value of the rotation rate depends on the precise dimensions of the aerodynamic surfaces and their configurations 150 in the first forward section 130 and the launch dynamics. Time to first GPS fix may be between twelve and twenty seconds after launch, and following first fix, subsequent fixes may be at one second intervals, the precise values possibly depending, at least in part, on the design characteristics of the chosen GPS unit. After several fixes have been obtained, the on-board electronic circuitry 140 (see FIG. 2) provides an approximate orientation for "down" from the curvature of the projectile trajectory, initially estimated to be accurate to about fifteen degrees. Solution accuracy improves with successive GPS fixes. When "down" is determined with sufficient accuracy, an integrated Inertial Measurement Unit (IMU), that may be an implementation use of the processors 146*a-n* of the on-board circuitry 140, locks this value into the system, and control solution computations are initiated, as further discussed elsewhere herein. Alternatively, instead of the IMU, a minimal sensor suite may be used to determine orientation of the projectile trajectory, for example only a single magnetometer or other similar sensor.

As discussed herein, the first forward section 130 of the RNCS 100 may be mounted on a shaft positioned at a small angle to the longitudinal axis of the projectile. In one embodiment, the small angle is five degrees, although different angles may be used with each configuration performing in a similar manner to that described herein. The DM 132 may be mounted on the second forward section 120 and provide a means of rotating the first forward section 130 relative to the second forward section 120. As the first forward section 130 is rotated about its axis through 180 degrees with respect to the second forward section 120, the axis of the nose cone aerofoil surface traces a path where the angle between the ogive axis 134 and the projectile longitudinal axis 102 varies sinusoidally from a minimum of zero to a maximum deflection of two times the value of the offset between the ogive axis 134 and the projectile longitudinal axis 102. For example, the maximum ogive deflection with respect to the longitudinal axis of the projectile body may be ten degrees in the disclosed embodiment, although different deflection magnitudes may be configured in accordance with the system described herein.

At one extreme of the DM rotary motion, the axis 134 of the first forward section 130 and the longitudinal axis 102 of the projectile are coincident. This is called the "ballistic" configuration and may be used during projectile launch. There may be a direct correlation between rotation of the first forward section 130 about its axis relative to the second forward section 120 and the resultant angle of attack of the nose cone ogive surface relative to local air flow. When the second forward section 120 is subsequently rotated with respect to the "down" plane as previously fixed by the IMU or other sensor, the deflected first forward section 130 may be caused to point in any desired direction within a volume defined by the surface of cone B as shown in FIG. 4, producing stable projectile angles of attack in any desired direction relative to the "down" plane. This effect permits both cross-range and down-range adjustment of the impact point.

Figure 8A:
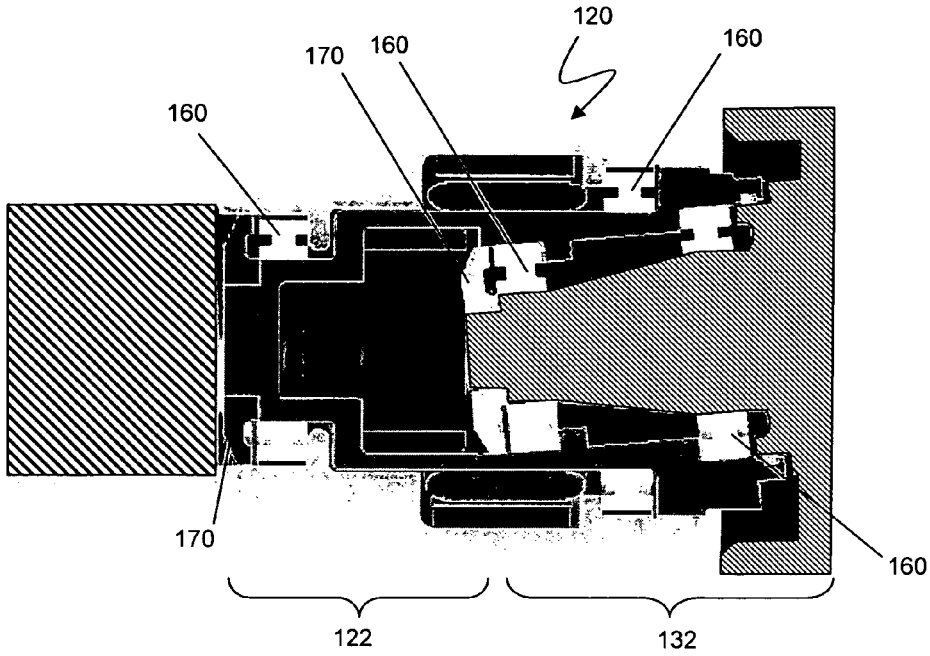
FIG. 8A is a schematic illustration of a Roll Motor Generator at a launch configuration according to an embodiment of the system described herein.
Figure 8B:
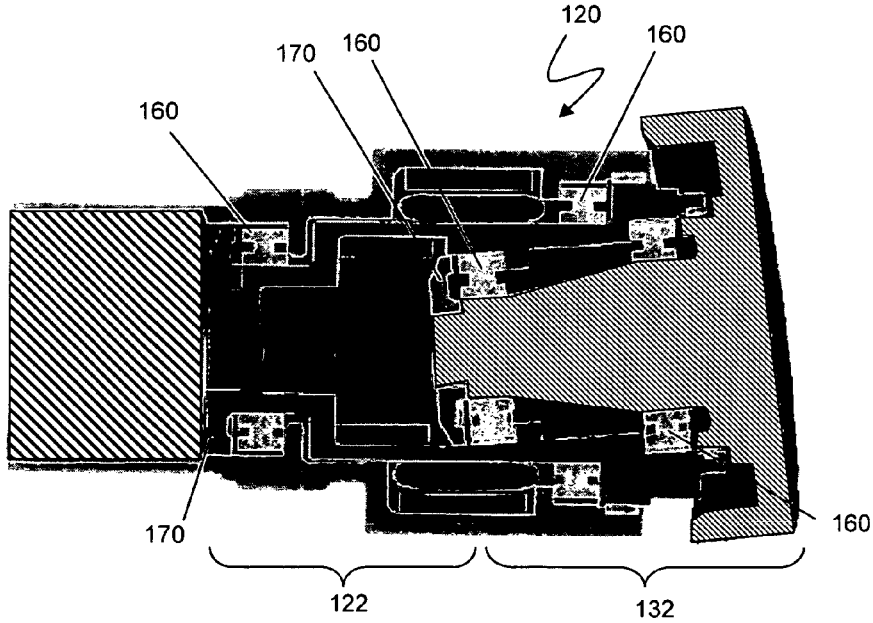
FIG. 8B is a schematic illustration of a Roll Motor Generator at maximum ogive section deflection according to an embodiment of the system described herein.

FIG. 8A shows a schematic illustration of the RMG 122 at a launch (ballistic) configuration, and FIG. 8B shows a schematic illustration of the RMG 122 at maximum ogive section deflection.

As seen in FIGS. 8A and 8B, radial bearings 160 may isolate adjacent elements that exhibit relative rotation, and the radial bearings 160 in turn may be isolated from high launch accelerations by being supported on spring elements 170. The embodiment illustrated in FIGS. 8A and 8B shows one of the radial bearings 160 being associated with spring elements 170, although it is also possible to provide a spring element for each and every one of the radial bearings 160. The spring elements 170 may permit a small longitudinal deflection under acceleration that facilitates the bearings transiently off-loading forward loads onto solid flat support elements during acceleration. In other embodiments, other mechanisms and configurations may be suitable for use with the system described herein to decouple motion of projectile components and provide roll control (see, for example, U.S. Pat. No. 6,646,242 to Berry et al. and U.S. Pat. No. 5,452,864 to Alford et al., which are incorporated herein by reference.)

Figure 9:
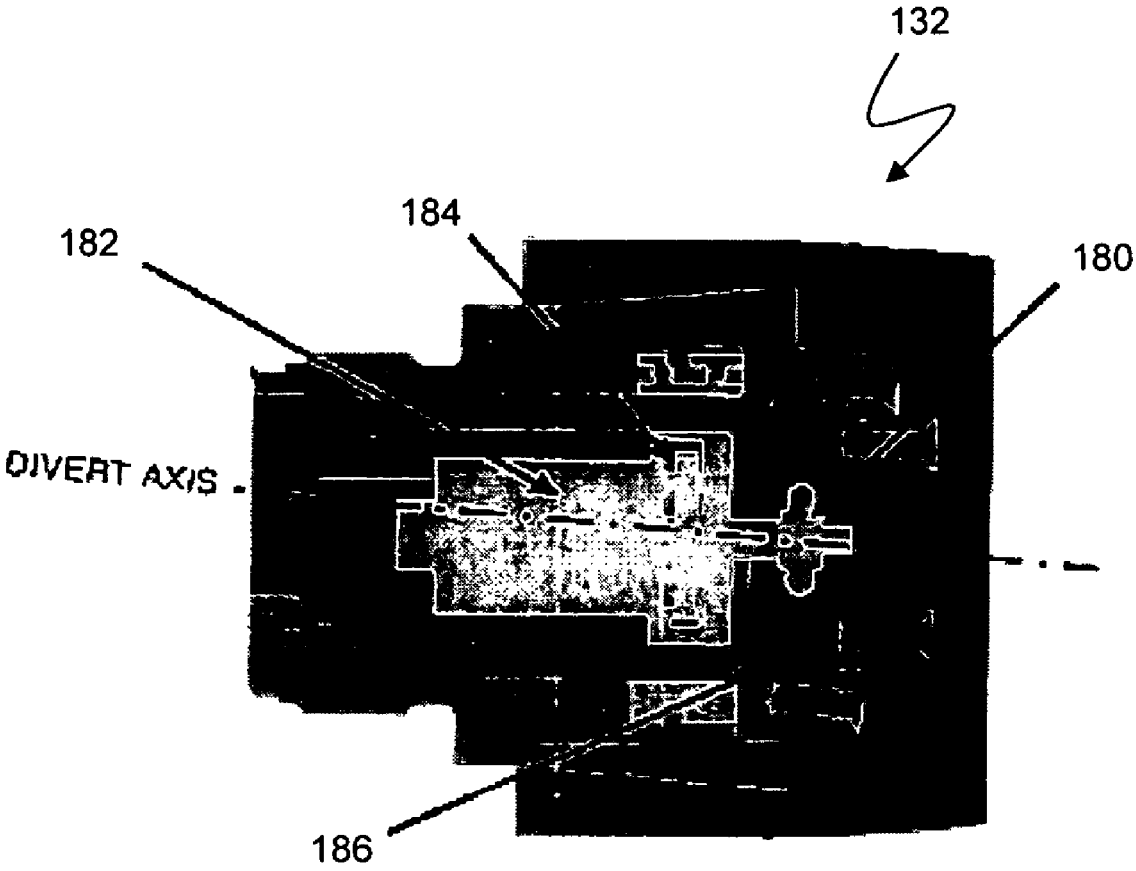
FIG. 9 is a schematic illustration of a Divert Motor according to an embodiment of the system described herein.

FIG. 9 shows a schematic illustration of design layout details for the DM assembly 132 according to another embodiment of the system described herein. The DM assembly 132 may include a Constant Velocity (CV) joint assembly 180, motor frame 182, a planetary reduction assembly 184, and solid support elements 186, which are illustrated in relation to the divert axis of the DM assembly 132.

The on-board processors (146*a-n*, see FIG. 2) may compute Modified Point Mass (MPM) trajectory solutions, or other trajectory solutions, iteratively based on latest GPS data and/or other trajectory data, and provide predictions of the mean point of impact (MPI) indicating the most probable impact point. The coordinates of the predicted fall of shot may then be compared with the target coordinates and R/theta correction information is generated. A control algorithm, executable by the on-board processors, may be provided with the R/theta correction information within the available maneuver authority and use the correction information to adjust the deflection and direction of the first forward section 130 by manipulation of the RMG 122 and/or DM 132 to drive the predicted impact of the projectile towards coincidence with the target coordinates, as further discussed elsewhere herein.

Figure 10:
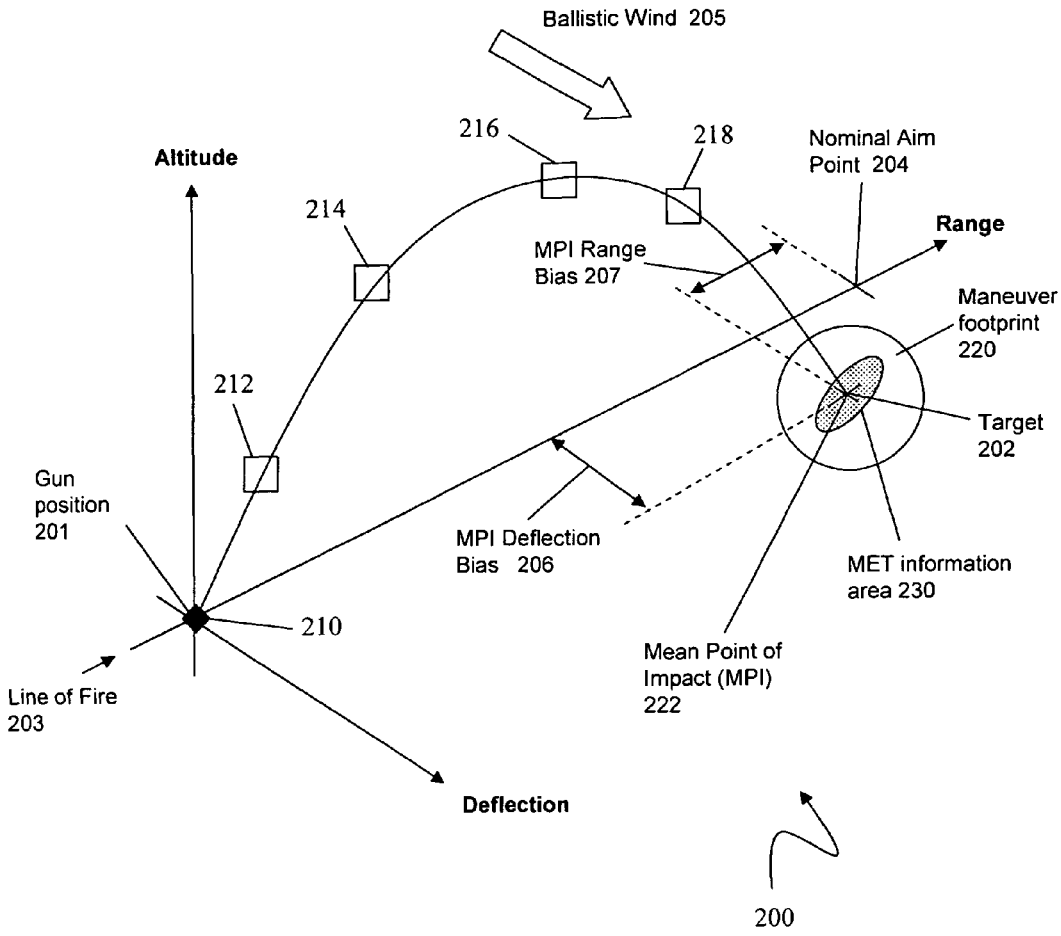
FIG. 10 is a schematic illustration of a projectile trajectory controlled by a Reconfigurable Nose Control System according to an embodiment of the system described herein.

FIG. 10 is a schematic illustration of a projectile flight path 200 with a trajectory controlled by an RNCS according to an embodiment of the system described herein. The flight path is shown plotted on axes of altitude, deflection and range. A launching mechanism or gun is shown at a zero coordinate position 201 and aimed in the direction of a target 202 via line of fire 203 towards a nominal aim point 204. In the scenario shown, a right drift characteristic of spin stabilized projectiles and/or a ballistic wind 205 may cause a mean point of impact (MPI) deflection bias 206 and drag or other environmental conditions may cause an MPI Range bias 207.

As part of pre-firing procedures before launch as shown at position 210, the RCNS 100 may be initialized by data uploading such as by fuze setting, which may include uploading of trajectory information, such as target coordinates. After the projectile is launched, at trajectory position 212 on the up leg of the projectile flight path, RNCS actions may include nose cone despinning procedures, initiation of on-board power generation, first acquisition of a GPS data signal, and initiation of an MPI predictor algorithm to calculate a trajectory solution and predict an MPI 222 with currently-available information, as further described elsewhere herein. At other trajectory positions 214, 216 and 218 (for example, the position 216 being the trajectory apogee), trajectory corrections of the RNCS 100 may be initiated based on known information, including recently-received GPS signals, and/or other information, that is fed to the on-board processors to calculate an updated MPI 222 within a maneuver footprint 220 and to adjust the deflection and direction of the nose cone in the manner as described elsewhere herein. Other information during initialization may include most recent MET information (for example, two hour stale MET) that is available for a target area 230.

Figure 11:
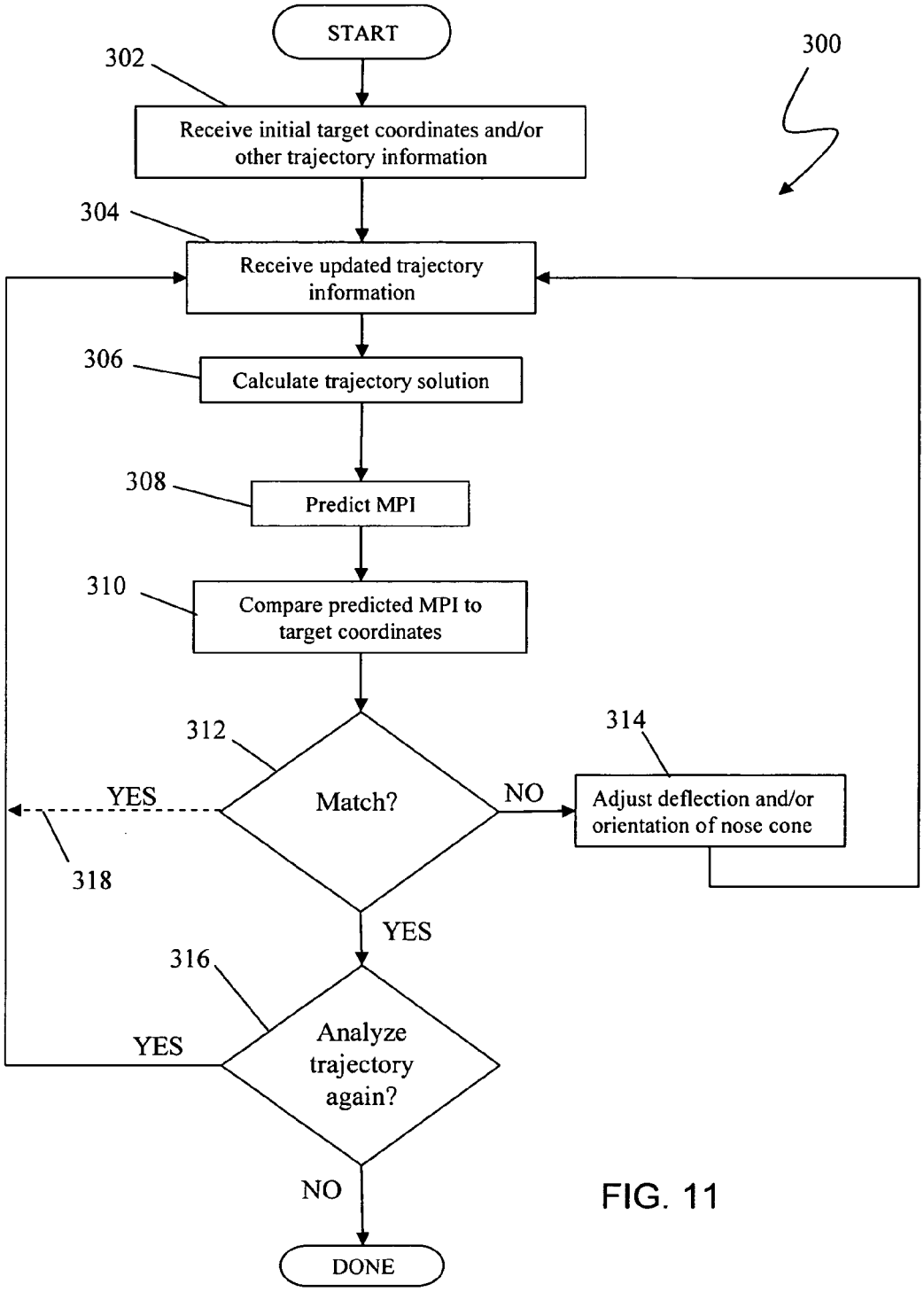
FIG. 11 is a flow diagram illustrating a process of projectile trajectory control and correction following launch of a projectile according to an embodiment of the system described herein.

FIG. 11 is a flow chart 300 illustrating a process of projectile trajectory control and correction following launch of a projectile according to the system described herein. Processing begins at a step 302 where the RCNS receives initial target coordinates and/or other trajectory information. Processing then proceeds to step 304 where the RCNS receives updated trajectory information data. The updated trajectory information may include updated GPS information, MET data, target coordinate information and/or other updated information. After the step 304, processing proceeds to a step 306 where the initial or updated target coordinate information and/or other trajectory information are transmitted to on-board electronic circuitry of the RCNS (for example, on-board electronic circuitry 140) which uses the received information to calculate a trajectory solution of the projectile. After the step 306, processing proceeds to a step 308 where the on-board electronic circuitry predicts an MPI. Then, at a step 310, the predicted MPI is compared to the target coordinates.

Following the step 310 is a test step 312 where it is determined whether the predicted MPI matches the target coordinates within an acceptable margin. The acceptable margin depends upon a variety of functional factors familiar to one of ordinary skill in the art, including the desired accuracy and acceptable amount of error. If the match is not determined acceptable at the test step 312 then processing proceeds to a step 314 at which the deflection and/or the orientation of the nose cone is adjusted in the manner as discussed elsewhere herein. Following the step 314, processing proceeds back to the step 304 at which new updated trajectory information data is received.

It should be noted that there may be a delay during the operation of step 314 (as further discussed in reference to FIG. 12) in order to allow for the nose cone adjustment and subsequent trajectory correction of the projectile resulting from the nose cone adjustment. If it is determined at test step 312 that the match is acceptable according to established criteria for an acceptable match and according to defined tolerances, then processing proceeds to a test step 316 where a determination is made whether to analyze the trajectory again. If, at test step 316, the determination is made to analyze the trajectory again, then processing proceeds back to the step 304 where new trajectory information is received. On the other hand, if it is determined at the test step 316 not to analyze the trajectory again, then processing is complete.

The determination to analyze the trajectory again at the test step 316 may be made by an external operator, may be automatically determined based on a set cycle or time period, or may be autonomously controlled by the on-board electronic circuitry using a control algorithm. For example, the control algorithm may establish a "point-of-no-return" at a location on the trajectory after which no further trajectory modifications by the RCNS are performed. In other embodiments, adjustments to the trajectory may be continuously conducted by the RCNS, such that there is no test step 316 and, after the test step 312, processing automatically proceeds via an operation path 318 to the step 304. Executable code, stored in a computer readable medium such as non-volatile memory 142 of the on-board electronic circuitry 140, may be provided for carrying out the above-noted steps.

Figure 12:
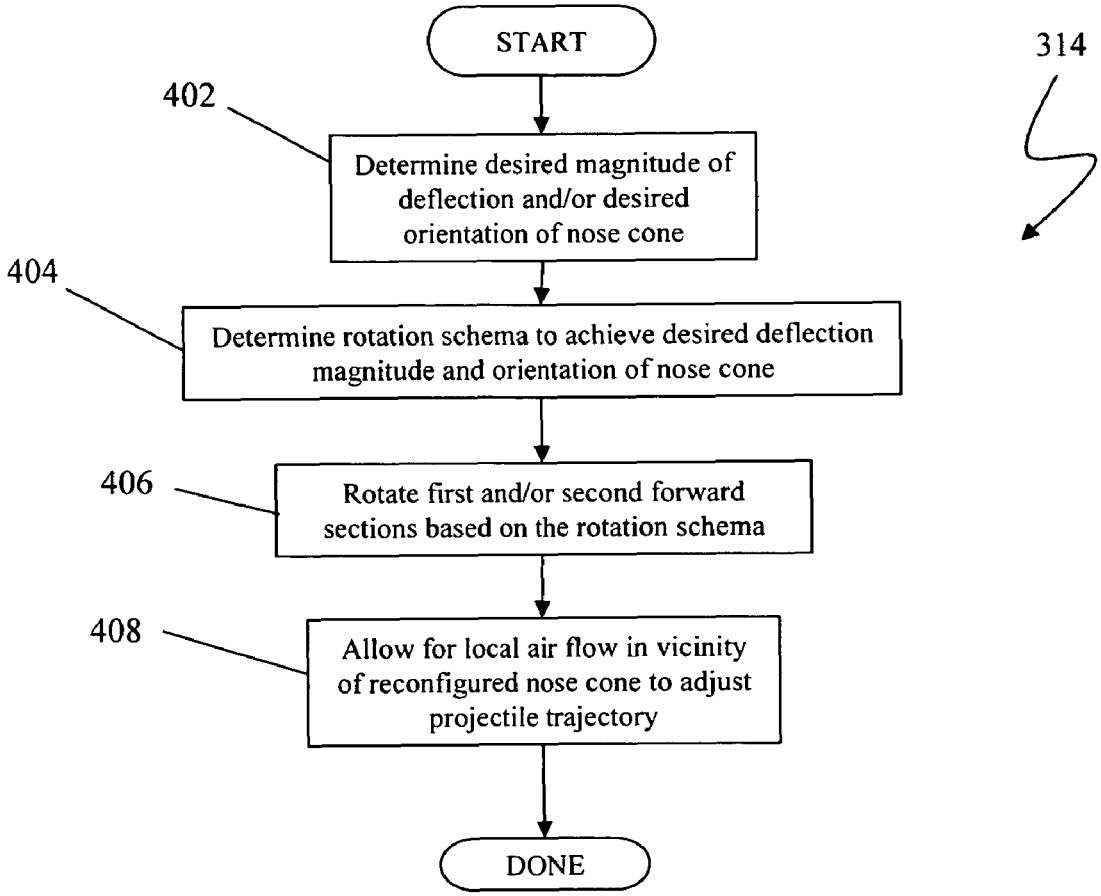
FIG. 12 is a flow diagram further illustrating adjustment of the deflection and/or orientation of the nose cone according to an embodiment of the system described herein.

FIG. 12 is a flow diagram further illustrating processing of the step 314 from FIG. 11 concerning adjustment of the deflection and/or orientation of the nose cone according to the system described herein. At a substep 402, a desired magnitude of deflection and/or orientation of the nose cone is determined in order to correct the trajectory of the projectile based on a comparison of a predicted MPI from the pre-corrected projectile trajectory with respect to target coordinates (see the step 310 of FIG. 11). After the substep 402, processing proceeds to a substep 404 where a rotation schema is devised for rotating the first and/or the second forward sections to achieve the desired magnitude of deflection and/or orientation of the nose cone and drive the projectile body to a particular angle of attack, as further described elsewhere herein. After the substep 404, processing proceeds to a substep 406 where the first and/or second forward sections are rotated according to the devised rotation schema. Thereafter, at a step 408, the system may allow sufficient time for the reconfigured nose cone to drive the projectile body to attain the angle of attack that modifies the trajectory of the projectile according to the determined trajectory corrections. Executable code, stored in a computer readable medium such as non-volatile memory 142 of the on-board electronic circuitry 140, may be provided for carrying out the above-noted steps. As discussed in reference to FIG. 1, after the nose cone adjustment step of 314, processing proceeds back to step 304 where updated trajectory information is received reflecting the corrections made to the projectile trajectory.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. An apparatus for controlling a trajectory of a projectile, comprising: a first section disposed on the projectile having a longitudinal axis that is at an axial offset with respect to a longitudinal axis of a projectile body and that rotates about the longitudinal axis of the projectile body; a second section disposed on the projectile that rotates about the longitudinal axis of the projectile body and is rotationally decoupled from the first section; and an on-board processor that controls rotation of the first section and rotation of the second section, wherein the on-board processor receives trajectory information during flight of the projectile and controls the rotations of the first section and the second section to adjust a predicted impact point of the projectile with respect to target coordinates, wherein a direction of the longitudinal axis of the first section is adjustably controllable by the on-board processor, independently of a direction of the longitudinal axis of the projectile body, using the rotations of the first section and the second section to control the trajectory of the projectile during the flight, and wherein a magnitude of an angle of deflection of the longitudinal axis of the first section with respect to the longitudinal axis of the projectile body is caused by the decoupled rotations of the first section and the second section during the flight.

2. The apparatus according to claim 1, wherein the on-board processor determines the predicted impact point of the projectile.

3. The apparatus according to claim 1, wherein, during the flight, the rotations of the first and second sections are controlled to cause the angle of deflection of the longitudinal axis of the first section to be zero with respect to the longitudinal axis of the projectile body.

4. The apparatus according to claim 1, further comprising:
a data receiver coupled to the on-board processor.

5. The apparatus according to claim 4, wherein the data receiver is a GPS unit.

6. The apparatus according to claim 1, wherein the first section includes an ogive portion.

7. The apparatus according to claim 1, wherein the first section includes aerodynamic surfaces on an external surface thereof to generate a roll torque.

8. The apparatus according to claim 1, further comprising:
a first motor that controls an orientation of the first section; and
a second motor that controls a deflection of the first section with respect to the longitudinal axis of the projectile body.

9. The apparatus according to claim 8, further comprising:
a generator that generates power from a spin differential between the projectile body and at least one of the first and second sections.

10. The apparatus according to claim 1, further comprising:
a base section that is coupled to the second section and rotates according to rotation of the projectile body.

11. The apparatus according to claim 1, wherein the on-board processor iteratively determines trajectory solutions during the flight of the projectile and iteratively adjusts the rotations of the first and second sections.

12. Computer software, stored in a non-transitory computer-readable medium, for controlling a trajectory of a projectile, comprising: executable code that receives trajectory information data of the projectile; executable code that receives a mean point of impact for the projectile based on the trajectory information data; executable code that compares the mean point of impact with target coordinates; and executable code that adjusts a trajectory of the projectile by controlling rotation of a first section of the projectile with respect to a longitudinal axis of a body of the projectile and rotation of a second section of the projectile with respect to the longitudinal axis, wherein the rotation of the first section is decoupled from the rotation of the second section, wherein a direction of a longitudinal axis of the first section is adjustably controllable, independently of a direction of the longitudinal axis of the projectile body, using the rotations of the first section and the second section to control the trajectory of the projectile during flight, and wherein a magnitude of an angle of deflection of the longitudinal axis of the first section with respect to the longitudinal axis of the projectile body is caused by the decoupled rotations of the first section and the second section during the flight.

13. The computer software according to claim 12, further comprising:
executable code that determines the mean point of impact for the projectile based on the trajectory information data.

14. The computer software according to claim 12, wherein, during the flight, the rotations of the first section and the second section are controlled to cause the angle of deflection of the longitudinal axis of the first section to be zero with respect to the longitudinal axis of the projectile body.

15. A method of controlling a trajectory of a projectile, comprising: receiving trajectory information data of the projectile; receiving a mean point of impact for the projectile based on the trajectory information data; comparing the predicted mean point of impact with target coordinates; and adjusting a trajectory of the projectile by rotating a first section of the projectile about a longitudinal axis of a body of the projectile and rotating a second section of the projectile about the longitudinal axis, wherein rotation of the first section is decoupled from rotation of the second section, wherein a direction of a longitudinal axis of the first section is adjustably controllable, independently of a direction of the longitudinal axis of the projectile body, using the rotations of the first section and the second section to control the trajectory of the projectile during flight, and wherein a magnitude of an angle of deflection of the longitudinal axis of the first section with respect to the longitudinal axis of the projectile body is caused by the decoupled rotations of the first section and the second section during the flight.

16. The method according to claim 15, further comprising: predicting the mean point of impact for the projectile based on the trajectory information data.

17. The method according to claim 16, wherein, during the flight, the rotations of the first section and the second section are controlled to cause the angle of deflection of the longitudinal axis of the first section to be zero with respect to the longitudinal axis of the projectile body.

18. The method according to claim 16, further comprising: despinning the first section and the second section after firing of the projectile.

19. The method according to claim 16, further comprising: generating power based on a spin differential between the body of the projectile and at least one of the first and the second sections.

20. The method according to claim 16, wherein the receiving, determining, comparing and adjusting steps are performed iteratively during flight of the projectile.

* * * * *